US007342510B2

(12) United States Patent
Pate

(10) Patent No.: US 7,342,510 B2
(45) Date of Patent: Mar. 11, 2008

(54) DISPLAYING INFORMATION ON A GATE SYSTEM

(76) Inventor: Alexs D. Pate, 1425 W. 35th St., Minneapolis, MN (US) 55408

( * ) Notice: Subject to any disclaimer, the term of this patent is extended or adjusted under 35 U.S.C. 154(b) by 258 days.

(21) Appl. No.: 11/132,005

(22) Filed: May 18, 2005

(65) Prior Publication Data

US 2006/0260166 A1 Nov. 23, 2006

(51) Int. Cl.
*G08G 1/00* (2006.01)

(52) U.S. Cl. ..... 340/928; 340/907; 340/908; 40/612; 49/49; 116/63 P; 246/473.1

(58) Field of Classification Search ..... 340/928, 340/907, 908, 908.1, 932.1; 116/63 P; 49/49; 246/473.1; 40/612; 705/13
See application file for complete search history.

(56) References Cited

U.S. PATENT DOCUMENTS

| | | | | |
|---|---|---|---|---|
| 3,950,873 | A | 4/1976 | Stehle et al. | |
| 4,872,149 | A | 10/1989 | Speas | |
| 5,844,181 | A | 12/1998 | Amo et al. | |
| 6,092,338 | A | 7/2000 | Crowner et al. | |
| 6,194,851 | B1 | 2/2001 | Denault et al. | |
| 6,317,684 | B1 | 11/2001 | Roeseler et al. | |
| 6,460,292 | B1 | 10/2002 | Rodriguez et al. | |
| 6,535,142 | B2 * | 3/2003 | Wakabayashi et al. | 340/929 |
| 6,690,293 | B2 * | 2/2004 | Amita | 340/928 |
| 6,812,888 | B2 | 11/2004 | Drury et al. | |
| 6,873,997 | B1 | 3/2005 | Majjasie et al. | |
| 6,987,734 | B2 | 1/2006 | Hundemer | |
| 2002/0124447 | A1 | 9/2002 | Burke | |
| 2002/0148424 | A1 | 10/2002 | Wakabayashi et al. | |
| 2002/0188550 | A1 | 12/2002 | Swartz et al. | |
| 2003/0154142 | A1 | 8/2003 | Ginsburg et al. | |
| 2003/0164753 | A1 | 9/2003 | Gongolas | |
| 2003/0195670 | A1 * | 10/2003 | Smith et al. | 340/928 |
| 2005/0056494 | A1 | 3/2005 | Amo et al. | |
| 2006/0289637 | A1 | 12/2006 | Brice et al. | |
| 2006/0293968 | A1 | 12/2006 | Brice et al. | |
| 2007/0008068 | A1 | 1/2007 | Brice et al. | |

OTHER PUBLICATIONS

Media-Frankfurt, "Public Parking Network", http://www.media-frankfurt.de (Nov. 2004).
Central Parking Corporation, "Parking Just Got Easier", http://www.parking.com/client/AmenMarketing.aspx (2004).
Traffic Management Products, Ltd., "The Story Thus Far", http://www.traffic-products.co.uk/tmp_group.htm (2003).
Traffic Management Products, Ltd., "Parking Products Index", http://www.traffic-products.co.uk/parking.htm (2003).

(Continued)

*Primary Examiner*—Benjamin C. Lee
*Assistant Examiner*—Samuel J. Walk
(74) *Attorney, Agent, or Firm*—Brooks, Cameron & Huebsch, PLLC

(57) ABSTRACT

Systems, methods, and devices, including program instructions, are provided for displaying information on a gate system. One embodiment includes a processor and a memory associated with a vehicle gate system. Program instructions are storable on the memory and executable by the processor to display target audience information.

15 Claims, 10 Drawing Sheets

OTHER PUBLICATIONS

"Outdoor Media Math Formulas", 2003.

Abcon Media, "Canada and U.S. Boom-Ad Gallery", http://www.abconmedia.com/imagesbo.html, 2006.

Fogg, John, "Inside Self-Storage Magazine Jun. 2003: Gates & Perimeter Fencing", http://www.insideselfstorage.com/articles/361feat2.html (Jun. 2003).

Gate Operators and Accessories, brochure, HySecurity, Seatte, WA, 2005.

"Report of the Property and Finance Committee- Appendix III", http://www.uwo.ca/univsec/board/minutes/1998/r9805pf2.html (May 1998).

MADD, Mothers Against Drunk Driving, http://www.madd.ca/english/news/pr/p05jan13.htm (Jan. 2005).

Abcon Media, "International Offices", http://www.abconmedia.com/contact.html, 2006.

Abcon Media, "Boom-Ad—Rates", http://www.abconmedia.com/ratesboom.html, 2006.

AutoGate, Inc., "EPS Barrier Gate Operators", http://www.autogate.com/esp.html, Aug. 14, 2004.

* cited by examiner

DISPLAYING INFORMATION ON A GATE SYSTEM

INTRODUCTION

Parking facilities see thousands of motorists every year. Whether a ground level parking lot or a multilevel parking deck, motorists must find locations to park. Advertising agencies are continually trying to find the right medium to appeal to their target audience. A lot of parking facilities provide a particular demographic or target audience that regularly goes untapped. Billboards and signs proliferate around such facilities, however, the sophistication with which they target the parking areas audience is unrefined. It is known to hang relevant ads from fixed structures or run promotion campaigns in certain areas. However, even these efforts do not reach the mass audience of people who park their vehicles each day.

Certain groups have attempted to add banners to gate arm structures. The downside to this is that attachments to such parking arm guards to date have only been loose fitting structures which are subject to vandalism, theft, and timeliness. If a particular retailer is going to pay for advertising in a parking facility they would like to know that there message will be present and be conveyed to the particular consumer at the optimal time of impression for which they are paying. Approaches to date have not been able to deliver this assurance.

Moreover, parking area owners do not want to be encumbered with additional headaches and management of their parking lots. These owners are particularly interested in low overhead and maintenance.

Parking gate system manufacturers are continually looking for ways to distinguish their products in a competitive market from those gate system products offered by other companies. Building owners would like to increase the attractiveness of being a tenant in their building by providing additional means of exposure and opportunities to stimulate revenue for their tenants.

To date there has been no real bridge between the voluminous audience of vehicle drivers and the advertising information interests of retailers, building owners and tenants, and parking area management.

DETAILED DESCRIPTION

Consumers dealing with an overflow of information would like to receive timely, relevant information, individualize to their particular interests and be able to quickly parse through the unwanted information to items of real value. Systems, methods, and devices, including program instructions, are provided for displaying information on a gate system. One embodiment includes a vehicle gate system which has a gate control mechanism, a gate connected to the gate control mechanism, and a cover having a first surface with printing directed to a targeted audience using the gate system. A fastener is coupled to the cover. The fastener provides a releasable, secure connection to the gate.

Another embodiment includes methods for electronically displaying information of interest to an individualized guest to a parking area. The information can relate to errands, traffic, sports scores, financial markets, breaking news, etc. According to various embodiments, this information can be delivered in real time with real meaning to a relevant target audience. These aspects and more will be apparent upon study of the following disclosure.

As the reader will appreciate, embodiments described herein can be performed by computer executable instructions (program instructions). However, various embodiments are not limited to any particular operating environment or to instructions written in a particular programming language. Software, firmware, and/or processing modules, suitable for carrying out embodiments of the present invention, can be resident in one or more devices or locations. Processing modules can include separate modules connected together or include several modules on an application specific integrated circuit (ASIC).

Figure 1:
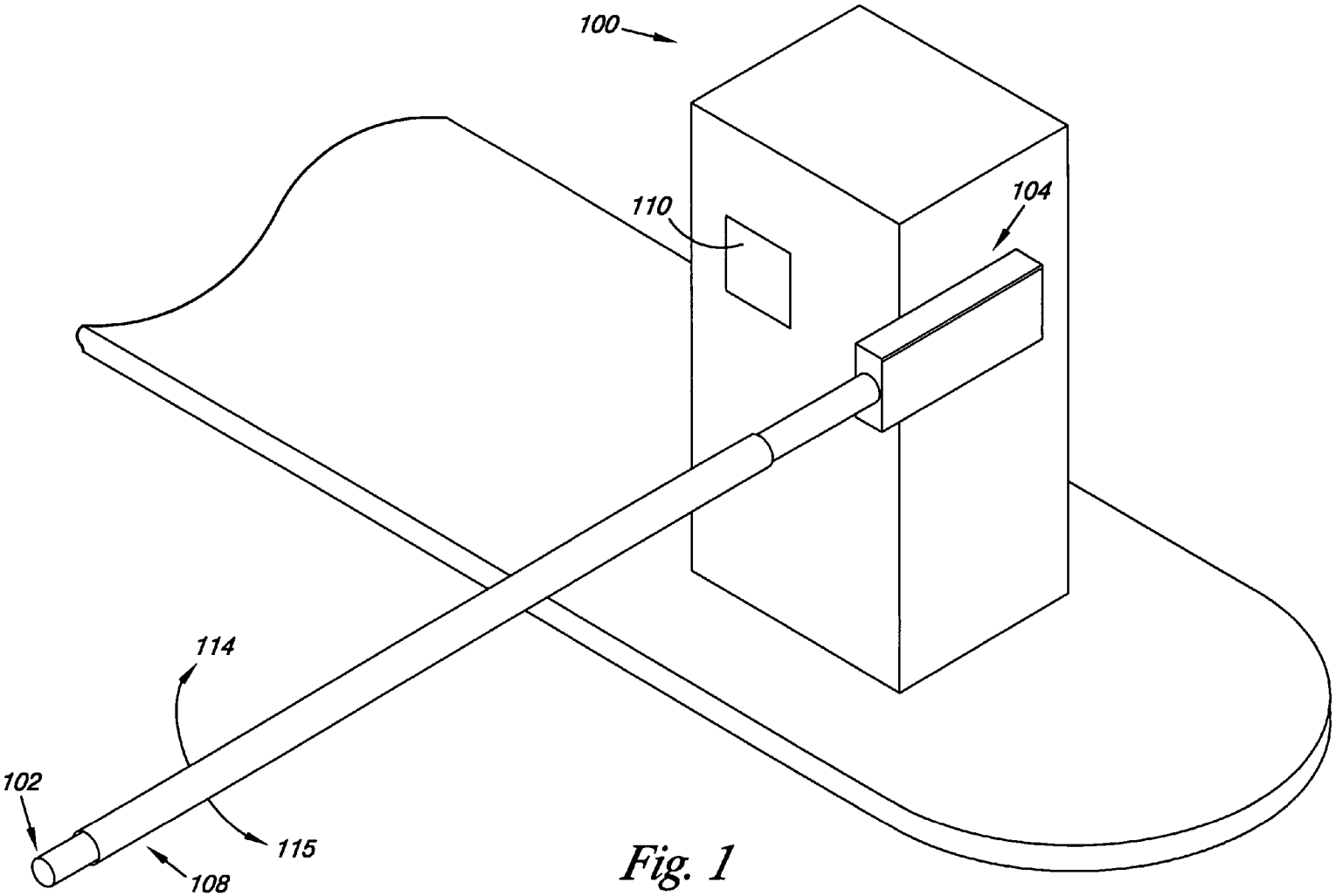
FIG. 1 illustrates an exemplary gate system.

FIG. 1 illustrates one embodiment of a gate system 100 for controlling passage of a vehicle. The gate system 100 includes a crossbar 102 coupled to a crossbar controller 104. The crossbar controller 104 includes an internal motorized gear mechanism that operates to raise 114 and lower 115 the crossbar 102 as vehicles pass through the gate system 100. In one embodiment, the gate system 100 can include an automated control mechanism having an electronic activating system 110 to detect the presence of a vehicle and to control an activation signal to the motorized gear mechanism for raising 114 and lowering 115 the crossbar 102. Examples of such automated control mechanisms include, but are not limited to, mechanical gears, hydrolics, cables, etc. and examples of electronic activating systems include sensors (e.g., RF, barcode, pressure, magnetic, optical readers, etc.) that detect the presence of a vehicle. Sensors can also include ticket dispensing and/or parking-card reading control mechanisms that control the action of the gate system 100. Other control and activation mechanisms are also possible.

As shown in FIG. 1, a sensor 110 can detect a signal from a vehicle as a vehicle approaches the gate, e.g., crossbar 102. A sensor 110 can, for example, be located along the drive to the gate, can be mounted to the gate system 100 (as shown in FIG. 1), the crossbar 102, etc. Embodiments, however, are not limited to these examples. The sensor can then generate a signal to authorize, and open the gate, charge the parking area guest a fee, etc. As one of ordinary skill in the art will appreciate, signals from the sensor 110 can also be used to count the number of vehicles that have approached the gate arm 102. This information can be used in determining an exposure rate (number of encounters over a given time interval) to the information provided to the gate as described in more detail below. The exposure rate can then be used to develop an exposure history, including a record of the number of vehicles, dates and times, etc., that can be used in marketing and advertising opportunities. Various characteristics such as peak travel periods (used to establish prime time periods) and average parking area occupancy (important in scheduling) can be tracked. As described in more detail below, the results of the characterization process can be stored as parking area characterization data in a database, or otherwise, for use in the scheduling process (discussed in connection with FIG. 8). FIG. 1 further illustrates one embodiment of a cover, e.g., sleeve, 108, placed over the crossbar 102.

Figure 2A:
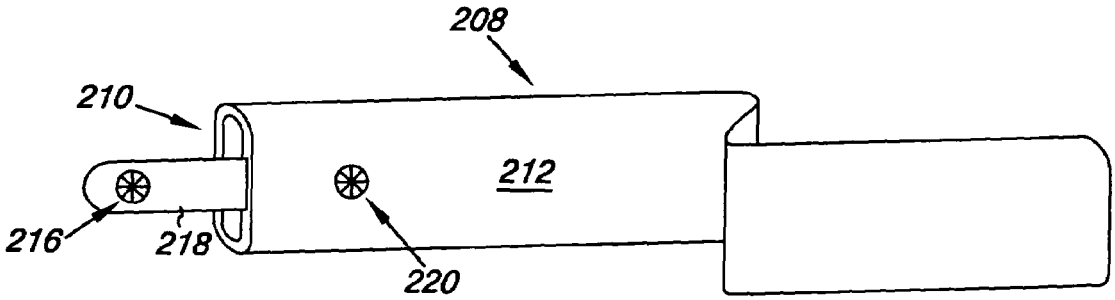
FIGS. 2A-2B illustrates an embodiment of an attachable cover to a gate of a gate system.
Figure 2B:
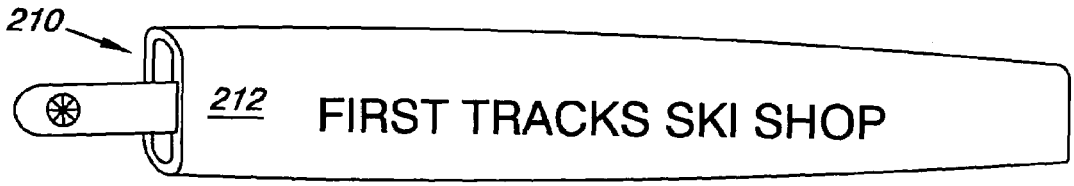

As shown in FIGS. 2A-2B, a cover 208 includes an elongate body 208 with a first end 210 to receive a crossbar, e.g., 102 in FIG. 1. In the embodiments shown in FIGS. 2A-2B the elongate body 208 of the cover 208 also includes a surface 212 with printing 214, e.g., "First Tracks Ski Shop", directed to a targeted audience viewing the cover 208. As used herein, a targeted audience includes a demographic population that an advertiser considers most likely to be a customer or potential customer. Examples of such a demographic population include those of business people, homemakers, sports fans, concert goers, participants in an athletic event, students, academic professionals, convention goers, and vacationers, just to name a few.

In one embodiment, determining a demographic population can be based on a number of factors. For example, such factors can include the demographics associated with a particular parking area (e.g., located in the financial district of town, next to the sports stadium, or in a suburban shopping complex) as well as the surrounding demographics, e.g., housing information such as the presence of condominiums, apartments, residential homes. In addition, one or more particular segments within an identified demographic may be used to identify the audience of the parking area.

In addition, the content of the text can be tailored not only to the demographic population but also to the proximate retail facilities. For example, the text presented on the cover 208 to incoming motorists can be directed to goods and services in and around the parking facility. These goods and services could include, but are not limited to, advertisements for coffee shops, cafes, restaurants, retail shops, and business located in the vicinity of the parking ramp. In addition, these advertisements can also be tailored to the time of day. For example, advertisements for a breakfast special at a nearby cafe could occur in the morning hours, whereas advertisements for dinner or entertainment events could occur in the afternoon and evening hours. The number of advertisement impressions (i.e., the number of times an advertisement is viewed) purchased, the advertisement start and end dates (e.g., start and end of a two week period), prime time requirements (i.e., prime time morning), number of impressions can be determined by the rate at which vehicles pass through a given gate system 100 as shown in FIG. 1. As described in more detail below, this information can then be used in assessing the effectiveness of the advertising and in determining fees.

Figure 3:
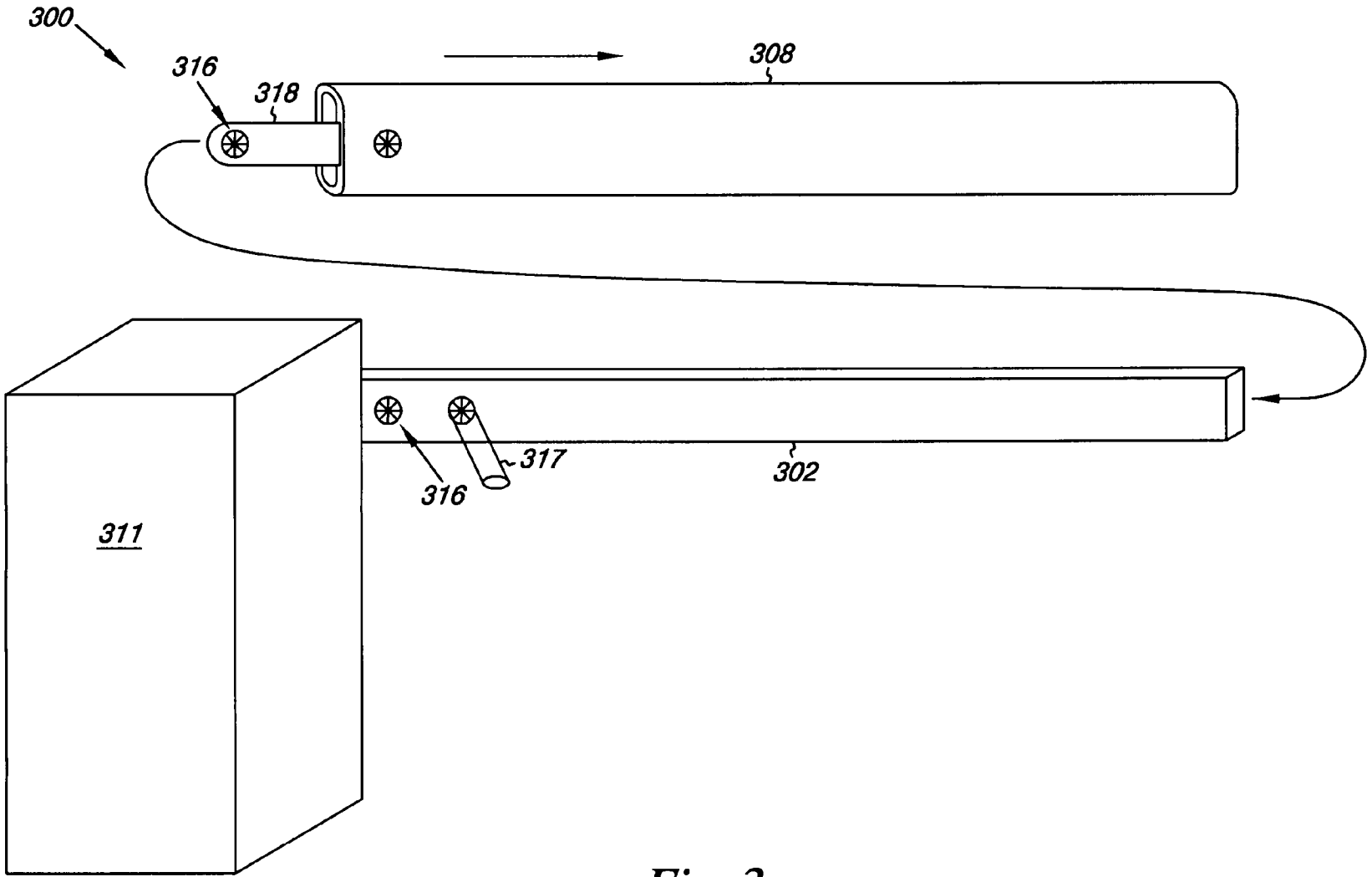
FIG. 3 illustrates an embodiment of a gate system having a cover attachable to its gate.

As shown in the embodiment of FIG. 2A, the cover 208 can further include a fastener 216 coupled to the elongate body 208, where the fastener 216 provides for a releasable, securable connection to a gate, e.g., locking mechanism 316 between crossbar 302 and a cover 308 on a gate system 300 (shown in FIG. 3). In one embodiment, the fastener 216 can include a releasable collar 218 that secures the first end 210 of the elongate body 208 to a gate, e.g., crossbar 302 in FIG. 3. By way of example and not by way of limitation, the releasable collar 218 is configured to at least partially engage the crossbar, e.g., 302 in FIG. 3, and the elongate body 208/308 so as to secure by holding the elongate body 208 to the crossbar 302 under a locking force. In some embodiments, the releasable collar 218 can include a cable tie that can be secured over and/or around the elongate body 208 so as to allow the elongate body 208 to be tightened onto the crossbar 302. The crossbar 302 can further include one or more grooves into which the releasable collar 218 and/or the elongate body 208 can be secured so as to prevent the elongate body 208 from being slid off the crossbar 302 whether through theft, collision, or other physical tampering, etc.

As the reader will appreciate, embodiments are not limited to these examples for a fastener 216. Likewise, embodiments are not limited to the placement and/or location of the fastening means. For example, a crossbar 102/302 and an elongate body 108/308 can each include components of a hook and loop fastening system, as the same will be recognized in the art, to allow the elongate body 208 and the crossbar 102/302 to be connected in a releasable but secure manner. In such embodiments, hook portions of the fastening system could be secured to the crossbar 102/302 while the corresponding loop portions could be secured to the elongate body 208/308, and vice versa. As will be appreciated, hook and loop systems having different degrees of coupling strength are available for use as the fastener 216.

Thus, in various embodiments, the fastener 216 can include a configuration in which an opening 220 is provided through the elongate body 208 that can receive a lock member (317 in FIG. 3 for example) to provide the releasable, secure connection to the crossbar 202. In one embodiment, the opening 220 can be located adjacent the first end 210. The lock member, e.g., rod, key lock, bolt, latch, bar, etc., can project, or extend, from a surface of a gate, e.g., crossbar 102/302. A lock member, and an opening 220 to the elongate body, are configured to allow the lock member to pass though the opening 220. In various embodiments, the opening through which the opening 220 passes over lock member can be reversibly altered in such a way as to secure the elongate body 208 to the crossbar 102/302. For example, a lock member could be configured as a shaft having an opening through which a lock can pass (e.g., a shackle of lock). The presence of the lock of the lock member would then prevent the opening 220 of the elongate body 208 from passing back over the shaft of the lock member.

As the reader will appreciate, other embodiments and configurations for "locking" the elongate body 208 to the crossbar 102/302 are also possible. In one embodiment, the collar 218 of the fastener 216 includes a strap extending from the elongate body 208, where the strap 218 can engage a portion of the crossbar 102/302 to provide the releasable connection to the crossbar 102/302 of the gate. For example, the strap 218 can be passed through one or more openings in the crossbar 102/302, passed over and/or crossed over one or more portions of the crossbar 102/302 and then secured to either the crossbar 102/302, the elongate body 208 or back onto the strap itself so as to secure the elongate body 208 to the crossbar 102/302.

FIG. 3 illustrates an embodiment of a gate system having a cover attachable to its gate. As illustrated in the embodiment of FIG. 3, the collar 318 of the cover 308 can be passed over a crossbar 302 and releasably secured with one or more fastening means 316 as the same have been described herein. As will be appreciated, a number of configurations for connecting the crossbar 302 and the cover 308 are considered within the scope of the present invention. The cover 308, e.g., elongate body, can have a number of different configurations. For example, the cover 308 can have the form of an elongate tubular body, e.g., sleeve, as illustrated in FIG. 3.

Figure 4A:
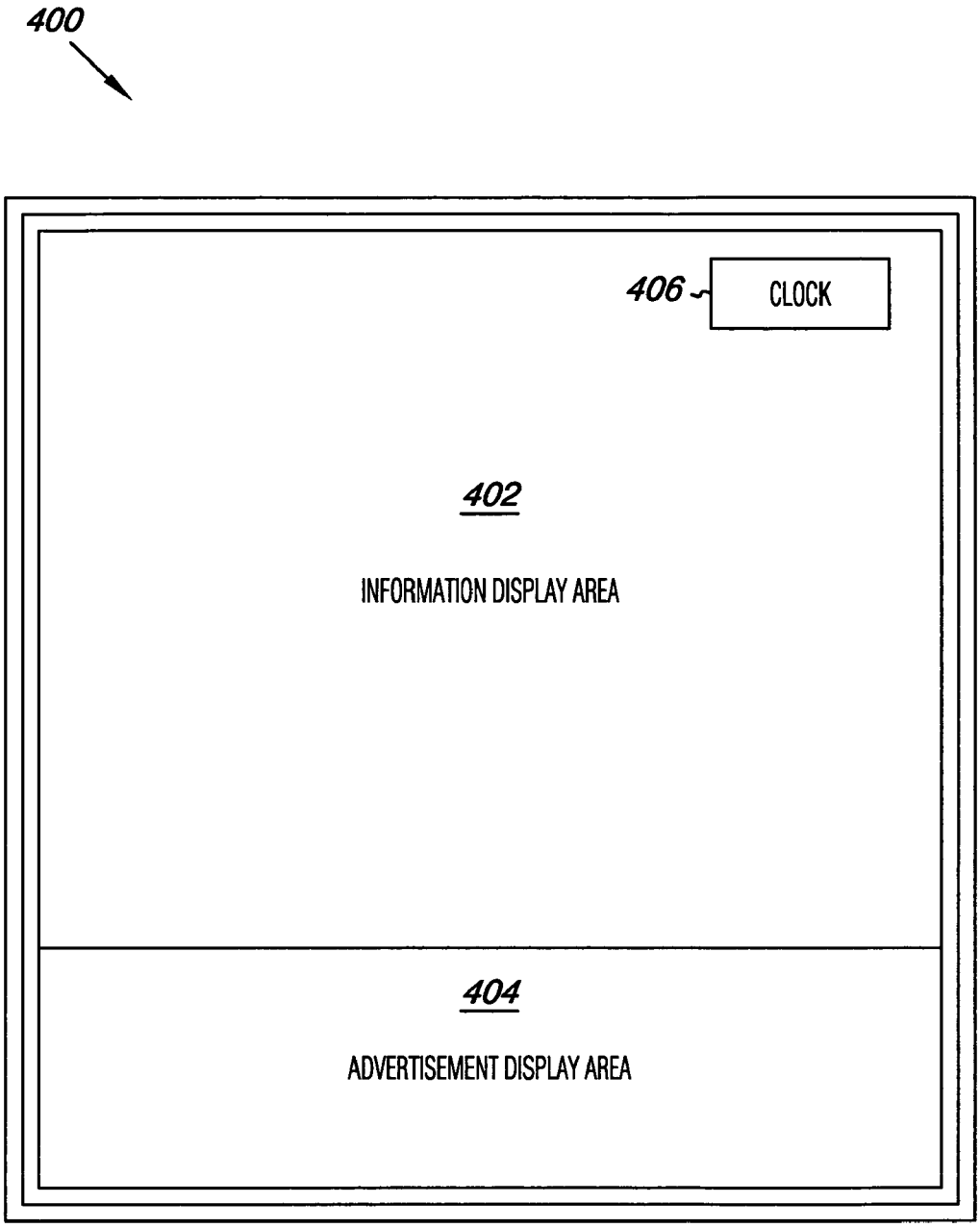
FIGS. 4A-4C illustrates various embodiments for electronic display units associated with a gate system.
Figure 4B:
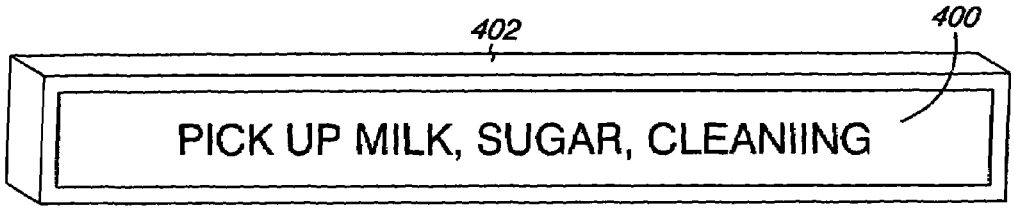
Figure 4C:
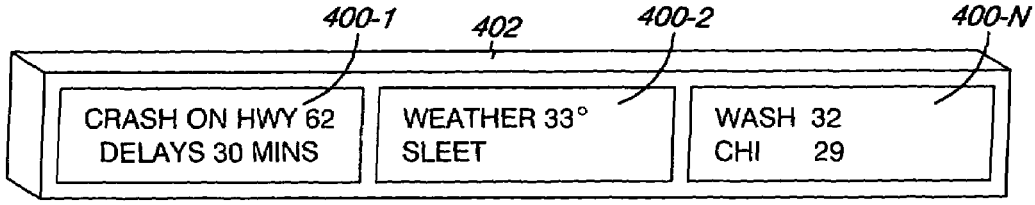

FIGS. 4A-4C illustrates an embodiment of a display 400 which, according to various embodiments, is incorporated into a gate system, e.g., crossbar 102 in FIG. 1. FIG. 4A illustrates a display unit 400. As shown in FIG. 4A, and discussed in more detail below, the display unit 400 can be divided into various regions of information, e.g., information display area 402, advertisement display area 404, a clock area 406, etc. According to various embodiments, the display unit 400 can be retrofitted to existing gate arm, e.g., 102 in FIG. 1. As the reader will appreciate, the display unit 400 can be fastened to an existing gate arm with bolts, clips, clamps, straps, etc. Embodiments are not so limited. In an alternative embodiment, the display unit 400 can be integrated to a cover that is placed on an existing gate arm, e.g., cover 108/208/308 as illustrated in FIGS. 1-3. For example, the cover 108/208/308 can include a vinyl cover having a liquid crystal display (LCD), plasma display, light emitting diode (LED) display, etc., embedded into fabric. Thus, in such embodiments, the cover can include stand alone electronics, without the need to integrate these electronics into the gate arm itself. The cover 108/208/308 can be a rigid cover, a flexible cover, or can be hung from the gate arm. The display unit 400 electronics can include field programmable gate arrays (FPGAs), organic light emitting device (OLED) technology (OLED), flexible OLED, flexible plastic thin-film transistor liquid crystal display (TFT LCD) technology, etc., that can handle the demands of displaying video content, including video clips, scrolling messages, text messages, etc. In an alternative embodiment, as shown in FIGS. 4B and 4C, the display unit 400 can be integrated directly into the gate arm 402 itself.

According to various embodiments, the display unit 400 is provided to the gate arms described herein to display targeted information to individuals, including advertising and other personalized information. As will be described in more detail below, the advertising and other information can include personalized information as requested by the individual. For example, in FIG. 4B, the display unit 400 can display information relevant to errands which are requested to be handled by a particular individual.

In FIG. 4B, for example, the display unit 400 is provided on and/or mounted to the gate arm. As will be described in more detail below, a portion of a gate that controls vehicles entering and exiting a location, can receive messages, e.g., text messages from another wireless source, as the same are known in the art, and correlate those messages for display to a particular individual at a particular time of day. The messages can be received stored and then later associated with a particular individual through recognizing that individual using a technology such as RFID, barcode, etc., as the same is know and understood by one of ordinary skill in the art. Thus, in the example embodiment of FIG. 4B, a vehicle having a particular RFID tag may approach the gate arm to exit a given parking area and the individual in that vehicle may be presented with particularized information. According to embodiments, a gate system will recognize the unique RFID tag and retrieve messages relevant to this particular individual, e.g., a message from a household member to pick up milk, sugar, and retrieve the cleaning on the individual's trip home.

One of ordinary skill in the art will appreciate the manner in which a server, associated with the parking area, can receive wired and/or wireless messages that are tagged for a particular guest to the parking area. A guest of the parking area may have a parking contract, or have registered in another manner, including use of the RFID tag purchased for their vehicle. As the reader will appreciate, radio frequency (RF) tagging can be used to identify an occupant of a vehicle. An apparatus can be attached to the vehicle or carried by the individual. As one of ordinary skill in the art will appreciate, radio frequency identification (RFID) is used for object identification. The RFID system includes an information carrying tag which functions in response to a coded RF signal received from a base station. The tag reflects the incident RF carrier back to the base station. Information is transferred as the reflected signal is modulated by the tag according to its programmed information protocol.

As known to one of ordinary skill in the art, RFID tags comprise a semiconductor chip having RF circuits, logic and memory. The RFID tag also includes an antenna, often a collection of discrete components, capacitors and diodes for example, a battery (in the case of active tags), a substrate for mounting the components and interconnections between the components. These elements are contained within a physical enclosure. One type of tag, the passive tag, has no battery and functions by deriving energy from the RF signal used to interrogate the tag. More detail is not provided herein, so as not obscure the embodiments of the present invention. Embodiments are not limited to RFID implementations for tagging messages, e.g., text messages, to a particular individual.

Once associated with a particular guest of the parking area, a parking area server (described in more detail below) can retrieve the individual (guest) specific message when the RFID indicates the individual's presence before the gate arm. As the reader will appreciate, the availability of such a personalized information service can be made available based on a subscription service.

FIG. 4C illustrates that, whether or not an individual has additionally paid for the above described subscription service, guest to the parking area can still, according to embodiments, receive useful information and/or particular targeted advertising. For example, in FIG. 4C the guest to the parking area may view displayed on the display unit 400, traffic information 400-1, weather information 400-2, sports scores 400-N, etc. The designator "N" is used to indicate that a variety of different information types and/or advertising can be displayed. As shown in the example embodiment of FIG. 4C, the display unit can be divided into a number of separate display units, e.g., as shown 400-1, 400-2, 400-N, etc., or can be one continuous display unit as shown in FIG. 4B. Embodiments are not limited to this example.

FIG. 4C further illustrates that an embodiment can include a combination of subscription service, e.g., personalized information, with other target audience information displayed. For example, the RFID capability associated with a particular guest to the parking area can further incorporate technologies such as global positioning system (GPS) and software (program instructions), which can access and operate on vehicle route information, to identify the individual's typical route of travel and alert the particular individual to particular traffic information, e.g., 400-1, associated with that route. The weather information, e.g., 400-2, may be general weather information for all guest to that parking area in a location based manner. While the sports scores, stock quotes, errand list, etc., e.g., 400-N, can be relevant to a particular RFID subscription user. As will be explained in more detail below, the embodiments described herein can distribute information based on date and time of day and/or in real time broadcasts. For example, advertising can be provided to one or more of the various display units, e.g., 400-1, 400-2, 400-N, which bear relevancy to the time of day and/or date. Coffee shops nearby the parking area can advertise specials and invite guest in the morning hours, gift shops can advertise Valentine's Day, Secretary's Day, etc., as business people are arriving to the parking area, etc. The real time information can include breaking news stories covered by leading news agencies, with the local election results on one portion, e.g., 400-1, the state and/or financial news on another portion, e.g., 400-2, and world news on yet another 400-N. This real time information can include current information that is refreshed at various intervals during a day. Embodiments are not limited to these examples and the reader will appreciate other variants to the above described examples.

Figure 5:
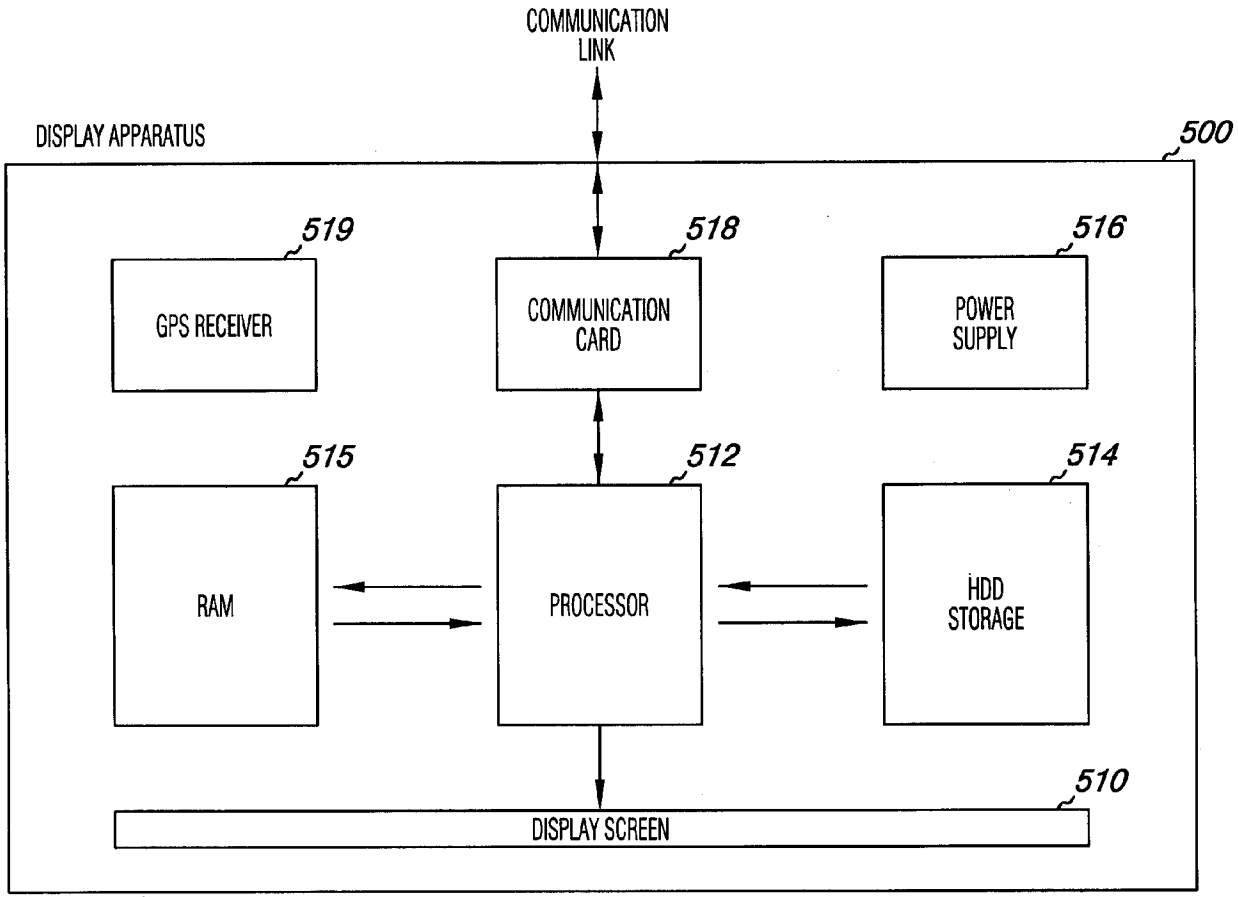
FIG. 5 illustrates an embodiment of the electronic components which may be associated with a display.

FIG. 5 illustrates an embodiment of the electronic components which may be associated with a display 500 provided to a gate arm of a gate system according to the embodiments described herein. As shown in FIG. 5, a parking area display 500 can receive and process data via a communication link 501. As described in more detail below the communication link 501 may be to a parking area server, etc. FIG. 5 illustrates that the display 500 can include a communication card 518 which is operable to receive wired and/or wireless signal, e.g., RF, from the communication link 501. One of ordinary skill in the art will appreciate the manner in which a network interface card (NIC), Ethernet card, etc., can be provided to a display 500, as the same has been described above, to receive electronic signals in a wired and/or wireless manner. Thus, as the reader will appreciate, the communications card 518 according to various embodiments can support RF, infrared, Bluetooth, or other signals, etc.

The electronic components to the display 500 embodiment of FIG. 5 further illustrate a processor 512 connected to memory, e.g., computer readable medium 514 and 515. One of ordinary skill in the art will appreciate the various types and sizes of processor and memory resources that can be provided to the display 500 according to various design rules. Examples of computer readable medium include random access memory (RAM), read only memory (ROM), flash memory, electronically erasable and programmable ROM (EEPROM), a floppy diskette, a compact disk CD-ROM, an optical disk, a hard disk, etc. In the example embodiment of FIG. 5 a RAM 515 and a hard disk drive (HDD) 514 are illustrated for storage of computer executable instructions (e.g., program instructions, or software) and data. Embodiments are not limited to these examples. The example electronic components of FIG. 5 further illustrate a suitable power supply 516 and a GPS receiver 519 for providing location based information. In FIG. 5 a display screen 510, as the same has been described above is also illustrated as part of the overall electronic components. These components, naturally, are not illustrated according to real life scale, but rather merely for purpose of illustration.

As will be described in more detail below, in some embodiments information to be displayed on the display 500 is transmitted to one or more parking area servers and then transmitted in according to a schedule stored on such servers to the displays, e.g., display 500. In such an embodiment it is possible that a display, e.g., 500, would not include a processor 512 and hard disk drive 514 on the display 500. This may be advantageous in embodiments where the display is integrated into a cover that is provided to the gate arm.

Figure 6:
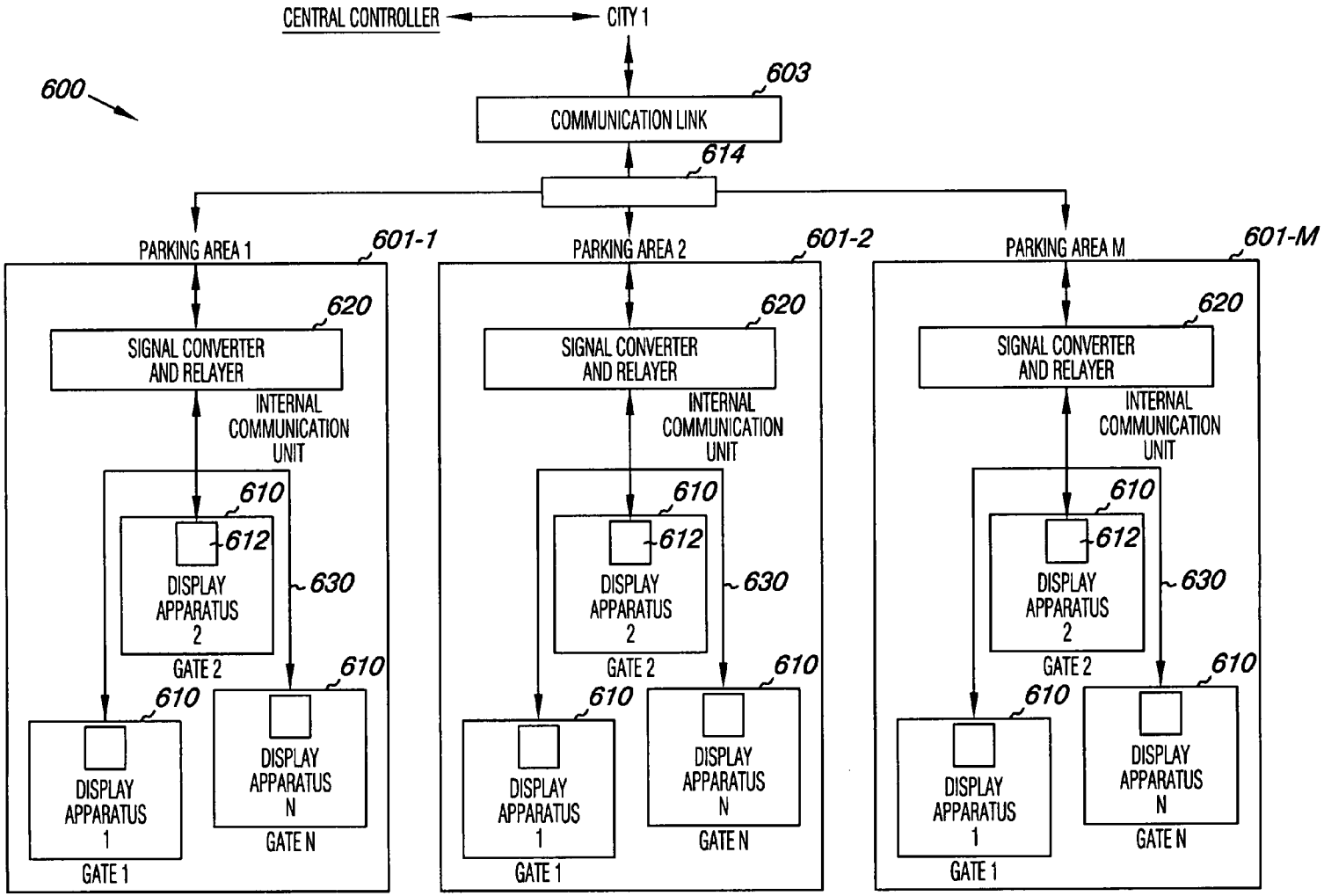
FIG. 6 illustrates a network embodiment of a number of parking areas served by one or more particular servers.

FIG. 6 illustrates a network embodiment of a number of parking areas, 601-1, 601-2, . . . , 601-M, served by one or more particular servers 614. The designator "M" is used to indicate that embodiments are not limited to the number of parking areas served by one or more particular servers 614. The one or more servers, 614, can receive instructions and data via a communication link 603, as the same has been described above. That is, instructions and data can be embodied as signals modulated on a carrier wave, e.g., radio frequency (RF), or transmitted over a physical transmission medium, e.g., a fiber optic medium, twisted wire pair, coaxial cable, etc. Thus, instructions and data may be propagated over a transmission medium such as electronic network channels, optical fibers, air, electromagnetic waves, RF links, etc. In the embodiment of FIG. 6, the network can include the Internet, Intranet, a local area network (LAN), wide area network (WAN), Internet, and/or wireless network, among others, including hardwire links, optical links, satellite or other wireless communications links, wave propagation links, or any other mechanisms for communication of information.

In FIG. 6 the one or more parking areas, 601-1, 601-2, . . . , 601-M, can each include their own server, receivers, and/or other signal converter and relayer, shown as 620. For example, a given parking area, 601-1, 601-2, . . . , 601-M, can include several gate systems 610 (e.g., gate 1, gate 2, gate N), as the same have been described above. Again, the designator "N" is used to illustrate that a number of gate systems 610 can be provided at a given parking area. Each of these gate systems 610 can include a display 612 as the same have been described above. It is anticipated the present system can be retrofitted with existing gate arms located at existing parking areas. As such, the use of a wireless communication link, e.g., 501 in FIG. 5, between the display 612 and the parking area's signal converter and relayer may ease the implementation of retrofitting. Furthermore, providing a display which is retrofitted to an existing gate arm may obviate the need to coordinate development and implementation with gate system manufacturers. It is noted, however, that in certain embodiments it is desirable to coordinate the development and implementation with gate system manufacturers in order to deliver added product differentiation to a given manufacturer's products.

As the reader will appreciate, various display embodiments provide an additional individuality by providing individual servers within a given parking area. As described in more detail below in connection with FIG. 7, such servers may be individually and uniquely addressable to allow information to be received by several parking areas as well as particular information received pertaining to a particular parking area, and even individualized to a particular guest of a parking area. For example, a parking area management organization might include regular programming information, information on interruptions due to maintenance, emergency procedures, neighboring tenancy vacancies, etc. Likewise, neighboring retailers may provide targeted advertising information for their businesses in addition to the parking area specific information.

As described in more detail below, if a given parking area is serviced by a centralized server, e.g., 714 in FIG. 7, a large amount of the information displayed can be synchronized with each parking area while still maintaining centralized control and delivery of generalized information to the other parking areas within a given city for instance. That is, parking area specific information does not have to interfere with information transmitted to other parking areas within a network of parking areas (as shown in FIG. 7).

Figure 7:
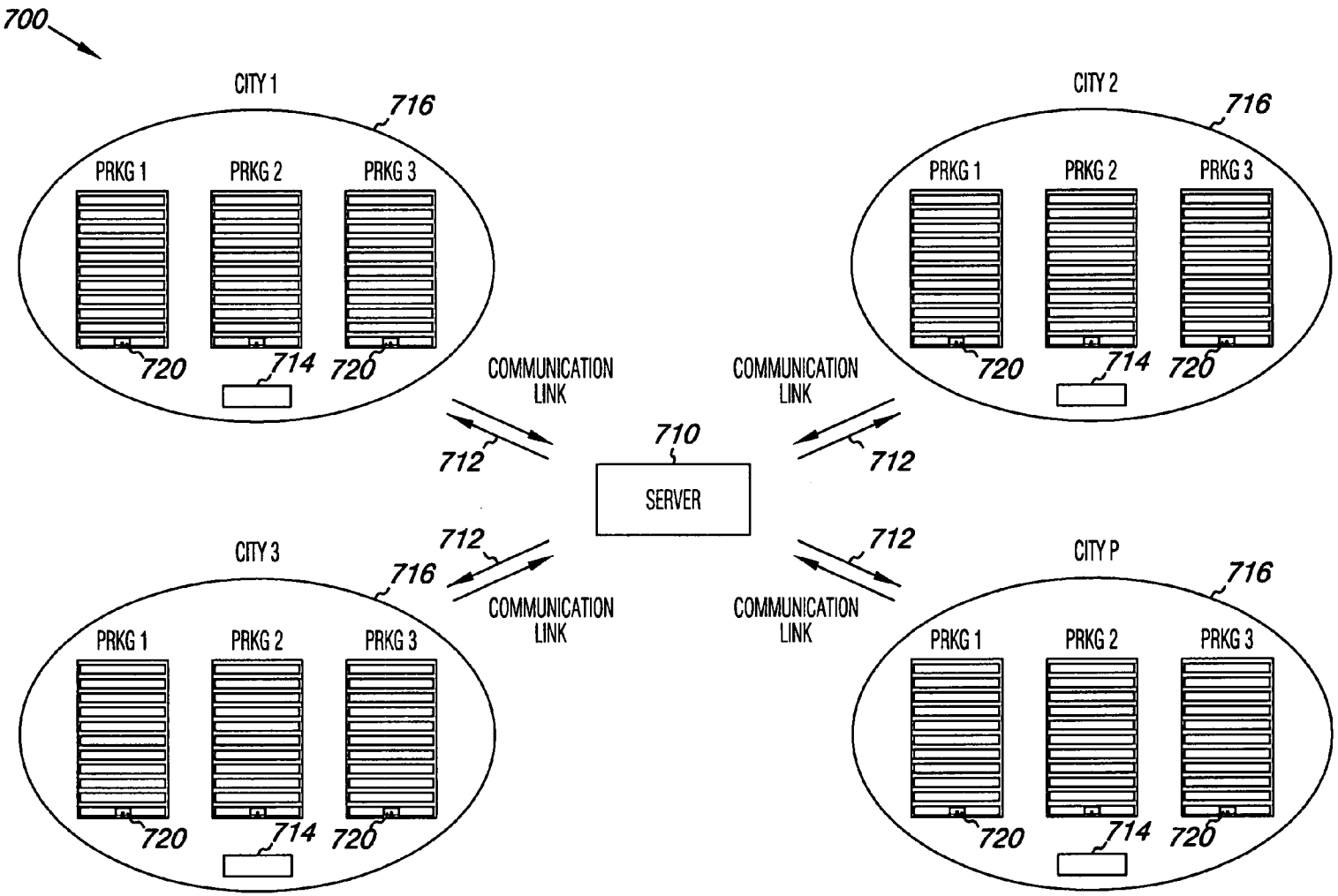
FIG. 7 illustrates a wide area network of parking areas within various cities as may be administered by a particular parking area management organization, or other service agency, and include embodiments as described herein.

FIG. 7 illustrates a wide area network (WAN) 700 of parking areas 716 within various cities (e.g., Cities 1, 2, 3, . . . , P) as may be administered by a particular parking area management organization, or other service agency. Embodiments are not limited to who administers the WAN 700 of parking areas 716 illustrated in the example embodiment of FIG. 7. As shown in FIG. 7, the WAN 700 of parking areas 716 can include a number of parking areas (e.g., prkg 1, prkg 2, prkg 3) within each city (e.g., Cities 1, 2, 3, . . . , P). Naturally, each city is not limited to three parking areas and a number greater than or less than three parking areas may be included in a given city as covered by the embodiments. FIG. 7 illustrates that embodiments can include a central server location or operations center 710 for the WAN 700 of parking areas 716. The example embodiment of FIG. 7 illustrates that one or more servers can be operated from the operations center 710. In the embodiment of FIG. 7, the servers of the operations center 710 can communicate via suitable communication links 712 (as the same have been described herein), with a server for one or more parking areas 714, e.g., within various locations in a city.

Each city may include one or more servers 714, however each server 714 can have associated therewith a number of parking areas in the given city. The city servers 714 can communicate in turn with individual parking areas within its group via communication links, for example via a telephone line, a wireless communication, infrared or any suitable communication link, as the same has been described above. As the reader will appreciate, within each parking area additional servers 720, e.g., 620 in FIG. 6, can be provided. As described above, such additional servers can be responsible for communicating with the individual gate systems within the parking area. A display unit, e.g., 400 in FIG. 4, can be located with each gate system for displaying information communicated thereto. In a further embodiment, the operations center 710 may be configured to communicate directly with the parking area servers 720 and not necessarily via the city servers 714. As used herein, a parking area may include a group of parking area, such as for example, a cluster of parking areas surrounding an office complex.

Figure 8:
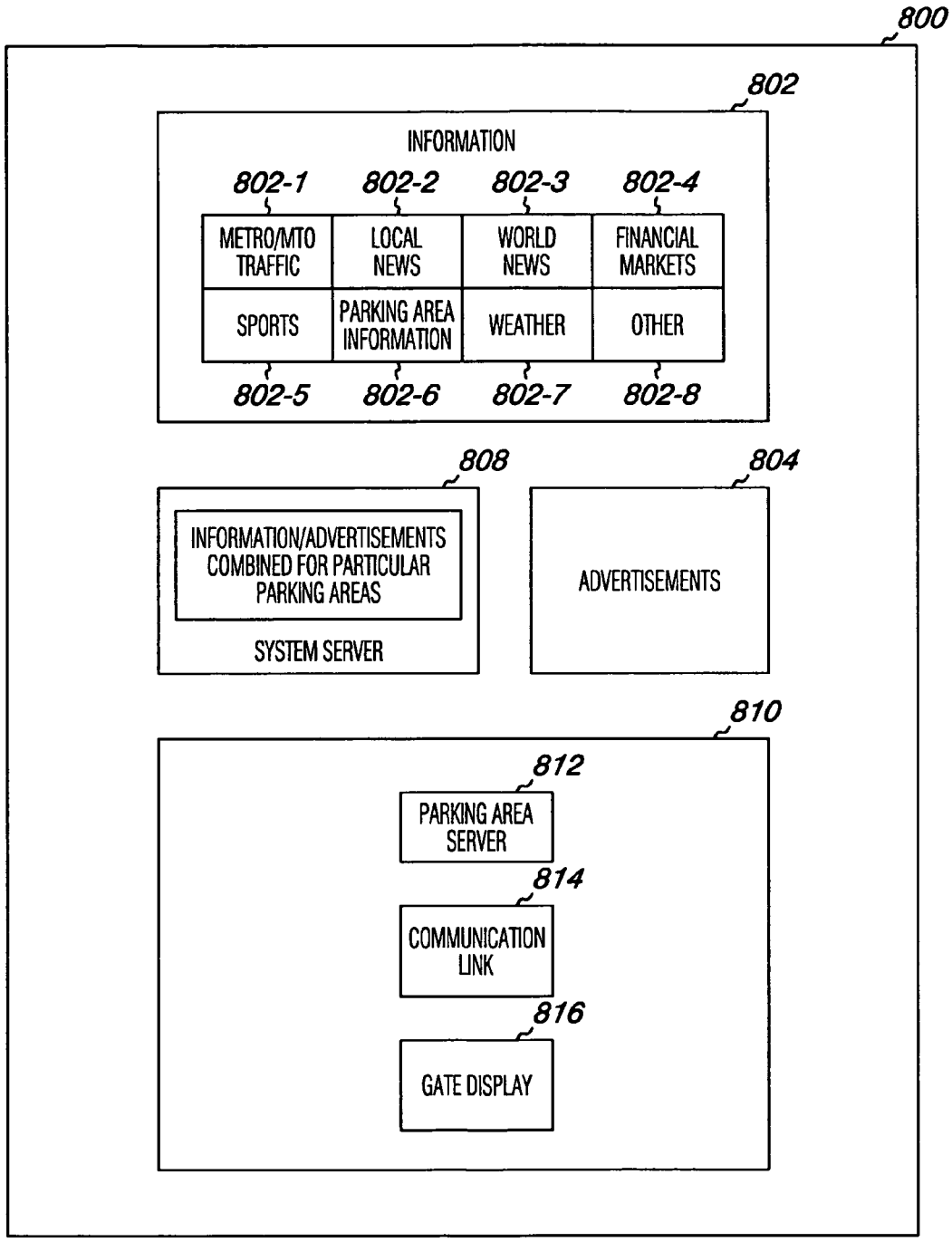
FIG. 8 is a block diagram illustrating an embodiment for information flow from a central control to a given display in a particular parking area.

FIG. 8 is a block diagram illustrating an embodiment for information flow from a central control to a given display in a particular parking area. In FIG. 8 the flow of information from a particular server, e.g., 710, 714, and/or 720 in FIG. 7, to individual displays, e.g., 400 in FIG. 4, associated with a given gate system is shown generally by numeral 800. In this example embodiment, the particular server 808 can gathers information 802 for transmission to the various parking area servers 812 associated with one or more parking areas as described in FIGS. 6 and 7. As illustrated in the embodiment of FIG. 8, the information 802 can include various types of information such as traffic reports 802-1, local news 802-2, world news 802-3, business and financial information 802-4, sports 802-5, parking area information 802-6, weather 802-7, as well as other information 802-8 including information relevant to several and/or specific cities and/particular parking areas. For example, the information may include parking area information which is specific to a particular and/or group of parking areas within a city or across several cities.

For example, in North America, it is not unusual for a single parking area management organization to own various parking areas in different cities. Should it be desired that parking area information, e.g., parking contract fee changes, be provided to several and/or particular parking areas, this information may be compiled at the particular server 808 and distributed to appropriate displays.

According to various embodiments, all parking areas can be individually addressable from the particular server 808. That is, specific information destined for a particular parking area may be communicated to respective displays associated with particular gate systems without effecting the information being displayed in other parking areas. The gate systems themselves can be individually addressable. For, example the specific information can be communicated to entrance and/or exit specific gate systems of a given parking area. Once delivered to a particular parking area 810 and parking area server 812, the information can be relayed to the appropriate displays via the communication links 814 as the same have been described herein. That is, the links may include wired and/or wireless, e.g., RF links, etc. In this manner, a display unit in any location can be reached from a particular control point and information provided to the displays in a consistent and timely manner. Furthermore, since the displays are individually addressable, information including advertising 804 can be selectively configured for a particular gate system. According to various embodiments, all of the information, including advertising 804, can be particularized to a given guest of a parking area.

Once the relevant information has been communicated to the appropriate display unit, information can be continually processed by a parking area server 812 according to a schedule which determines when particular information or advertisement information is to be displayed and in what sequence the information is to be displayed. For example, while the appropriate information is being displayed on a display unit, a parking area server can perform a continuous check of the date and time and perform a check for any changes in the appropriate information. Changes to the information may include changes in content of information to be displayed based on date, time, particular information for a particular individual, etc. Based on various criteria, as described above, information and/or advertisements are loaded and displayed on an appropriate display screen, e.g., 510 in FIG. 5.

Thus, concurrent display of information, advertising, and personalized "guest" information can be provided to the display. And, program instructions as described herein can check for appropriated changes to the information and advertising content and schedule and/or load the same. When the information and/or advertisements have completed display a next appropriate set of information and/or advertisements can be displayed. For example, the content can again be changed as a next criteria is satisfied, e.g., another particular individual pulls up to the gate. The sequence of information and/or advertisements can thus be provided as a seamless sequence of information, advertising, and personalized guest information. According to embodiments, a minimum and/or maximum exposure time, collectively and/or individually, can be applied to the display of the various types of information described above.

The information displayed may include high quality computer generated graphics, text messages, streaming video, or picture quality static images displayed for a predetermined period of time, e.g., videos, animations or any combination of information. Furthermore, embodiments can include audio capabilities in conjunction with the images or audio alone. Embodiments are not limited to these examples for conveying information, advertising, and personalized guest information.

In the above embodiment, the information to be displayed on the screens is uploaded from the parking area server 812 to the individual display units, e.g., 400 in FIG. 4, of a gate system. In various embodiments, the information can be processed according to the schedule included with the information. In another embodiment, the information may be delivered in real time from the parking area 812 server to the display units. In such embodiments, the display units do not have to store any significant amount of information thereon. In various embodiments, the display units themselves may also provide for the return of diagnostic or maintenance information back to the server 812 in order that the display unit may be monitored remotely without the need for maintenance personnel intervention, etc., thus further reducing the overall cost of the embodiments described herein. In a still further embodiment, the parking area server 812 may receive information for display not only from a particular control server 808 but also from other broadcast information sources, e.g., national broadcast networks such as CNN, satellite providers (as described in connection with FIG. 9), and/or direct internet access. Embodiments are not limited to these examples.

Figure 9:
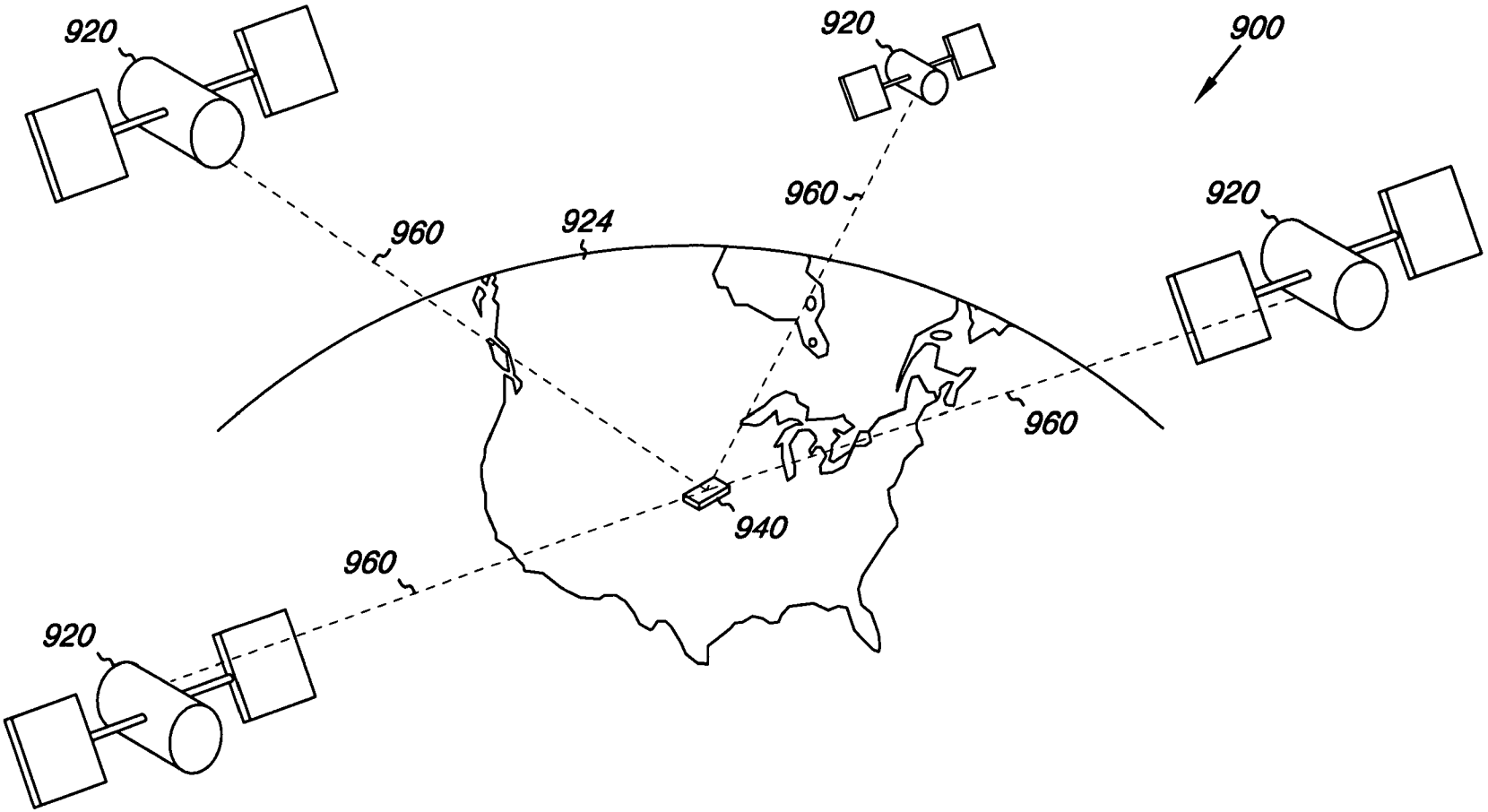
FIG. 9 illustrates a satellite network which can include GPS capabilities and be used in conjunction with the embodiments described herein.

FIG. 9 illustrates a satellite network 900 which can include GPS capabilities and be used in conjunction with the embodiments described herein. As shown in FIG. 9, a number of satellites 920 are in orbit about the earth 924. The satellite network shown in FIG. 9 can include, but is not limited to, GPS, Sirius, XM, Dish, DirecTV, or any other satellite provider network, etc., as the same are know and understood by one of ordinary skill in the art. The orbit of each satellite 920 is not necessarily synchronous with the orbits of other satellites 920 and, in fact, is likely asynchronous. A satellite receiver device 940, which can include a GPS receiver is illustrated receiving satellite signals 960, which can include GPS signals, and/or other information content from the various satellites 920. As the reader will appreciate the satellite receiver device can be located with a parking area server, e.g., 812 in FIG. 8, or even with individual gate systems within a parking area. Embodiments are not limited to these examples.

These satellite signals 960, continuously transmitted from each satellite 920, utilize a highly accurate frequency standard accomplished with an extremely accurate atomic clock. Each satellite 920, as part of its data signal transmission 960, transmits a data stream indicative of that particular satellite 920, etc. It will be appreciated by those skilled in the relevant art that in GPS embodiments the satellite receiver device 940 must acquire spread spectrum GPS satellite signals 960 from at least three satellites 920 for a GPS receiver device 940 to generate its two-dimensional position by triangulation. Acquisition of an additional signal 960, resulting in signals 960 from a total of four satellites 920, can permit a GPS receiver device 940 to generate its three-dimensional position. As such position information can be provided to the parking area server, e.g., 812 in FIG. 8, individual gate systems within a parking area, and/or program embodiments within such systems and servers, as the same have been described herein.

As the reader will appreciate, program embodiments according to the present disclosure include the ability to execute instructions to receive content and/or data from one or more satellite networks 920. Indeed, program embodiments can execute instructions to receive different signals from different satellite network providers. For example, one satellite network can provide one or more different kinds of content and/or data, including but not limited to GPS data, general information, subscriber service information, etc. The subscriber service information can include information such as personal messages from acquaintances, personalized advertisements as streaming media, personalized guest information of interest (such as preferred news, sports, weather, traffic), etc. According to various embodiments, program instructions execute to provide the above described information based on, or relevant to, a particular guest and/or gate system location.

As the reader will appreciate, content and/or data available from a satellite network 920, a cellular network and/or other network (not shown) can include positioning data, analog data, digital data, audio, video, cartographic data, directory information, news, entertainment, weather information, communications data, etc. Program embodiments according to the present invention can execute instructions to receive and use as criteria all such information.

Although specific embodiments have been illustrated and described herein, those of ordinary skill in the art will appreciate that an arrangement calculated to achieve similar techniques can be substituted for the specific embodiments shown. This disclosure is intended to cover adaptations or variations of various embodiments of the invention. It is to be understood that the above description has been made in an illustrative fashion, and not a restrictive one. Combination of the above embodiments, and other embodiments not specifically described herein will be apparent to those of skill in the art upon reviewing the above description. The scope of the various embodiments of the invention includes any other applications in which the above structures and methods are used. Therefore, the scope of various embodiments of the invention should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for location based information display on a vehicle gate system, comprising:

providing a gate arm associated with the gate system with a means for displaying information;

providing targeted information to the display means based on GPS receiver and RFID reader capabilities located on the gate arm and interacting with the display means, and an RFID tag associated with a vehicle proximate to the gate arm.

2. The method of claim 1, wherein the method includes using the REID reader capabilities to identify a user profile and to retrieve relevant information for a particular individual.

3. The method of claim 1, wherein the method includes providing local news and local weather relevant to a particular location of the gate arm based on the GPS receiver capabilities.

4. The method of claim 1, wherein the method includes providing targeted information to the display means which is according to a subscription based service.

5. The method of claim 1, wherein the method includes providing a sports score to the display means.

6. The method of claim 1, wherein the method includes providing a vehicle route to the display means based on the GPS receiver and the RFID reader and tag capabilities.

7. The method of claim 1, wherein the method includes providing an errand request to the display means target to a particular individual based on the RFID reader and tag capabilities.

8. A system for electronically displaying information on a vehicle gate system, comprising:

a gate arm connected to the vehicle gate system;

a display connected to the gate arm;

a processor and a memory connected to the vehicle gate system;

a wireless receiver connected to the processor and the memory, wherein the receiver is operable to receive target audience information; and wherein the memory includes program instructions executable by the processor to select and display particular target audience information from among received target audience information based on particular criteria, the particular criteria including a time of day and a location of the vehicle gate system.

9. The system of claim 8, wherein the receiver is operable to receive an RFID signal particular to an individual, and wherein the program instructions can execute to select and display particular target audience information based the RFID signal.

10. The system of claim 9, wherein the particular target audience information includes an advertisement.

11. The system of claim 9, wherein the particular target audience information includes a financial report.

12. The system of claim 8, wherein the receiver is operable to receive an RFID signal particular to an individual, and wherein the program instructions can execute to select and display traffic information based on the RFID.

13. The system of claim 12, wherein the program instructions can execute to suggest a route.

14. A computer readable medium having executable instructions stored thereon to cause a vehicle gate system to perform a method, comprising:

electronically displaying information to the vehicle gate system, the information including:

advertisements targeted to a particular individual; and personal information targeted to the particular individual.

15. The medium of claim 14, wherein the method includes displaying information based on a subscription service.

* * * * *